United States Patent [19]

Goldberg et al.

[11] Patent Number: 4,567,452

[45] Date of Patent: Jan. 28, 1986

[54] BROAD-BAND BEAM BUNCHER

[75] Inventors: David A. Goldberg, Walnut Creek; William S. Flood, Berkeley; Allan A. Arthur, Martinez; Ferdinand Voelker, Orinda, all of Calif.

[73] Assignee: The United States of America as represented by the United States Department of Energy, Washington, D.C.

[21] Appl. No.: 591,651

[22] Filed: Mar. 20, 1984

[51] Int. Cl.[4] ..... H01J 25/10

[52] U.S. Cl. ..... 332/7; 313/360.1; 315/5.42; 315/5.51; 328/227

[58] Field of Search ..... 331/79, 81, 82; 332/7; 313/359.1, 360.1, 363.1, 361.1; 315/3.5, 3.6, 5, 5.39, 5.41, 5.42, 5.51, 39, 39.3; 328/227, 228, 233, 234

[56] References Cited

U.S. PATENT DOCUMENTS

| | | | |
|---|---|---|---|
| 2,860,279 | 11/1958 | Hester et al. | 315/5.42 |
| 3,177,440 | 4/1965 | Marcuse | 330/44 |
| 3,178,653 | 4/1965 | Smith | 331/6 |
| 3,289,033 | 11/1966 | Saburi | 315/5.51 X |
| 3,904,917 | 9/1975 | Ueda | 315/5.39 |

*Primary Examiner*—Siegfried H. Grimm
*Attorney, Agent, or Firm*—Clifton E. Clouse, Jr.; Roger S. Gaither; Judson R. Hightower

[57] ABSTRACT

A broad-band beam buncher is disclosed, comprising an evacuated housing, an electron gun therein for producing an electron beam, a buncher cavity having entrance and exit openings through which the beam is directed, grids across such openings, a source providing a positive DC voltage between the cavity and the electron gun, a drift tube through which the electron beam travels in passing through such cavity, grids across the ends of such drift tube, gaps being provided between the drift tube grids and the entrance and exit grids, a modulator for supplying an ultrahigh frequency modulating signal to the drift tube for producing velocity modulation of the electrons in the beam, a drift space in the housing through which the velocity modulated electron beam travels and in which the beam is bunched, and a discharge opening from such drift tube and having a grid across such opening through which the bunched electron beam is discharged into an accelerator or the like. The buncher cavity and the drift tube may be arranged to constitute an extension of a coaxial transmission line which is employed to deliver the modulating signal from a signal source. The extended transmission line may be terminated in its characteristic impedance to afford a broad-band response and the device as a whole designed to effect broad-band beam coupling, so as to minimize variations of the output across the response band.

10 Claims, 5 Drawing Figures

BROAD-BAND BEAM BUNCHER

The United States Government has rights in this invention pursuant to Contract No. DE-AC03-76SF00098 between the United States Department of Energy and the University of California.

FIELD OF THE INVENTION

This invention relates to a broad-band beam buncher adapted to modulate an electron beam into a series of bunches, corresponding to an ultrahigh frequency modulating signal, which may be varied in frequency over a broad band, such as from 1 to 4 gigahertz (GHz), for example. The frequency band may be varied widely. The beam buncher provides a broad band output characteristic with only tolerable variations within the response band. The bunched electron beam may be supplied to a high voltage accelerator or the like. Because of the broad band output, the beam buncher is very useful in accelerators, for testing accelerator related components, and for other purposes. The invention is also applicable to the bunching of positive ions and other charged particles.

BACKGROUND OF THE INVENTION

The klystron is a well known resonant or narrow band device which utilizes electron beam bunching. In a klystron, which is a velocity-modulation tube, a beam of electrons is emitted from an electron gun, usually comprising a heated electron emitting filament or cathode with an associated focussing electrode. After being accelerated, the electron beam passes through grids in the walls of a reentrant cavity resonator, often called the buncher, in which each electron receives an additional acceleration, either positive or negative, depending upon the phase and magnitude of the gap voltage during the passage of the electron across the gap. The modulated beam, containing electrons of varying velocities, enters a drift space in which the variations in the electron velocity produce density modulation of the electron beam. Because the velocity of each electron is determined by the excitation phase during which it crosses the buncher gap, an electron which was accelerated will overtake an electron which started earlier but was retarded. In this manner, the electrons tend to bunch together as they travel down the drift tube. The bunching effect is maximized at particular drift distances.

In the klystron, the bunched beam passes through the catcher or output cavity resonator, which is located at the point where bunching is at a maximum. Accordingly, the electrons enter the catcher in pulses, one pulse per cycle. In the cathode, the fundamental frequency component of the beam current, as represented by the bunches and intervening regions of low electron density, drives the output resonator into oscillation. With proper adjustment, the amount of signal power required to produce the bunching effect is relatively small, compared with the amount of energy delivered by the electron beam to the catcher. As a result, the klystron tube is usable as a power amplifier. If a portion of the output power from such amplifier is fed back to the input resonator in the correct phase, self-sustained oscillations will be produced.

The power gain in a klystron originates from the combination of velocity modulation and bunching of electrons during their transit time across the drift space.

In the klystron, the electron beam is accelerated by an accelerating voltage between the electron gun and the first grid of the buncher gap. A stream or beam of electrons having a constant velocity and a constant current density is delivered to the first grid and passes into the modulation gap between the first and second buncher grids. In passing across the modulation gap, each electron is either speeded up or slowed down due to the alternating radio frequency voltage between the first and second grids. The phase of the radio frequency field at the time of the electron's transit determines whether the electron is speeded up or slowed down, and to what extent. Thus, the electrons are velocity modulated as the electron beam passes through the second grid and into the drift space.

In the drift space, electrons which were speeded up in the modulation gap begin to catch up with the slower electrons which are ahead of them, thereby resulting in bunching of the electrons. The bunched electron beam passes across the output gap in the output cavity resonator. The bunches form pulses at the modulating frequency. Such pulses deliver power at such frequency to the output cavity resonator. Harmonics are also present in the bunched electron beam, but a klystron normally uses only the fundamental frequency to excite the output cavity resonator.

The klystron is a resonant, single frequency device having a very narrow output band. For certain important purposes, it would be very advantageous to provide a broad-band beam buncher which would have a broad output band, so that the frequency of the modulating signal could be varied over a wide range, to produce output bunches or pulses over a correspondingly wide range.

SUMMARY OF THE INVENTION

One object of the present invention is to provide a new and improved beam buncher having a broad-band output, so that an electron beam can be modulated to form bunches over a wide frequency range. A broad-band beam buncher is extremely useful for supplying variable frequency beam bunches over a broad band to a high voltage accelerator for testing purposes, and for other applications.

A klystron is basically a single-frequency device, which is not usable for broad-band beam bunching. Resonant cavities are used in klystrons but are unsuitable for broad-band bunching. The klystron employs a single modulating gap in conjunction with a cavity resonator, but a single modulating gap is unsuitable for broad-band beam bunching. In a klystron, a device designed to operate at a single frequency, no attempt is made to provide broad band coupling of the buncher cavity to the beam.

To achieve the objective of broad-band beam bunching, the present invention provides a broad-band beam buncher having a substantially non-resonant bunching structure. In addition, the bunching structure is designed so as to make the coupling of the modulating signal to the beam as broad banded as possible, a feature which will hereafter be referred to as broad banded beam coupling. The details as to how broad banded beam coupling is accomplished are described herein in the detailed description of the illustrative embodiment.

The non-resonant beam bunching structure comprises two modulating gaps connected by a short drift tube, which should not be confused with the drift space of a klystron. The drift tube is mounted at the midplane of a buncher cavity. Such buncher cavity and the drift tube are preferably arranged so that they act as extensions of the outer and inner conductors, respectively, of a transmission line which furnishes the modulating signal. The far side of the drift tube is connected to terminating means for the transmission line, preferably a terminating resistor attached to a monitoring port. With such terminating impedance, the modulating structure may match the characteristic impedance of the input transmission line, so as to virtually eliminate variations of the response of the input circuit across the band.

In some cases, the terminating impedance may be somewhat greater than the characteristic impedance of the transmission line to increase the voltage of the modulating signal at selected frequencies within the band, while maintaining broad-band response as a result of the broadbanded beam coupling, with tolerable variations in the response across the broad band.

The present invention may provide a broad-band beam buncher, comprising a housing adapted to be evacuated, an electron gun in such housing for producing a beam of electrons, buncher means in such housing forming a buncher cavity having an entrance opening for receiving the electron beam and an exit opening through which the electron beam passes out of the buncher cavity, a drift tube electrode in the buncher cavity and disposed between the entrance and exit openings with first and second gaps between the drift tube electrode and the entrance and exit openings, the drift tube electrode having a first drift space therein through which the electron beam passes in travelling between the entrance and exit openings, modulating means for supplying an ultrahigh frequency modulating signal to the drift tube electrode for producing velocity modulation of the electrons in the electron beam as the electrons pass through the buncher cavity and through the drift tube electrode between the entrance and exit openings, drift space means on such housing forming a second drift space for receiving the velocity modulated electron beam from the exit opening, such velocity modulated electron beam being bunched as it passes along the second drift space, such drift space means having a discharge opening through which the electron beam is discharged from the second drift space after being bunched therein.

The beam buncher may include a voltage source for producing a positive voltage between the buncher cavity means and the electron gun for imparting velocity to the electron beam as it passes into the buncher cavity through the entrance opening.

The beam buncher may comprise an entrance grid across the entrance opening, an exit grid across the exit opening, grids across the opposite ends of the drift tube electrode, and a grid across the discharge opening from the second drift space.

The modulating means may comprise a signal source for producing an ultrahigh frequency signal and a transmission line connected between the signal source and the drift tube electrode.

The buncher cavity and the drift tube electrode may constitute extensions of the outer and inner conductors of such transmission line.

Terminating means may be connected to the drift tube electrode for terminating the transmission line in approximately its characteristic impedance to afford a broad response band with minimum variations therein.

In some cases, the terminating means may comprise a terminating impedance substantially greater than the characteristic impedance of the transmission line, to afford an enhanced modulation level, at selected frequencies within the band, while maintaining a broad-band response, as a result of broad-banded beam coupling, with tolerable variations therein.

The bunched electron beam from the beam buncher may be supplied to a high voltage accelerator, which may be of the Van de Graaff type, for example. The broad-band beam buncher is extremely useful for accelerator related applications and other purposes.

BRIEF DESCRIPTION OF THE DRAWINGS

Further objects, advantages and features of the present invention will appear from the description, taken with the accompanying drawings, in which.

DETAILED DESCRIPTION OF ILLUSTRATIVE EMBODIMENT

Figure 1:
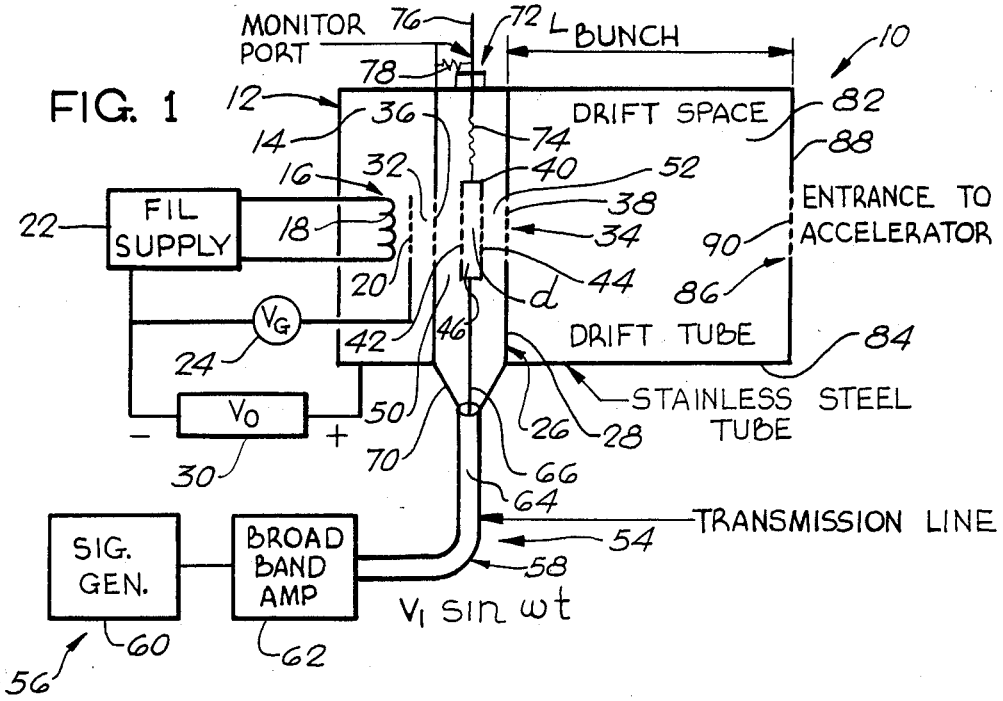
FIG. 1 is a diagrammatic sectional view of a broad-band beam buncher to be described as an illustrative embodiment of the present invention.
Figure 2:
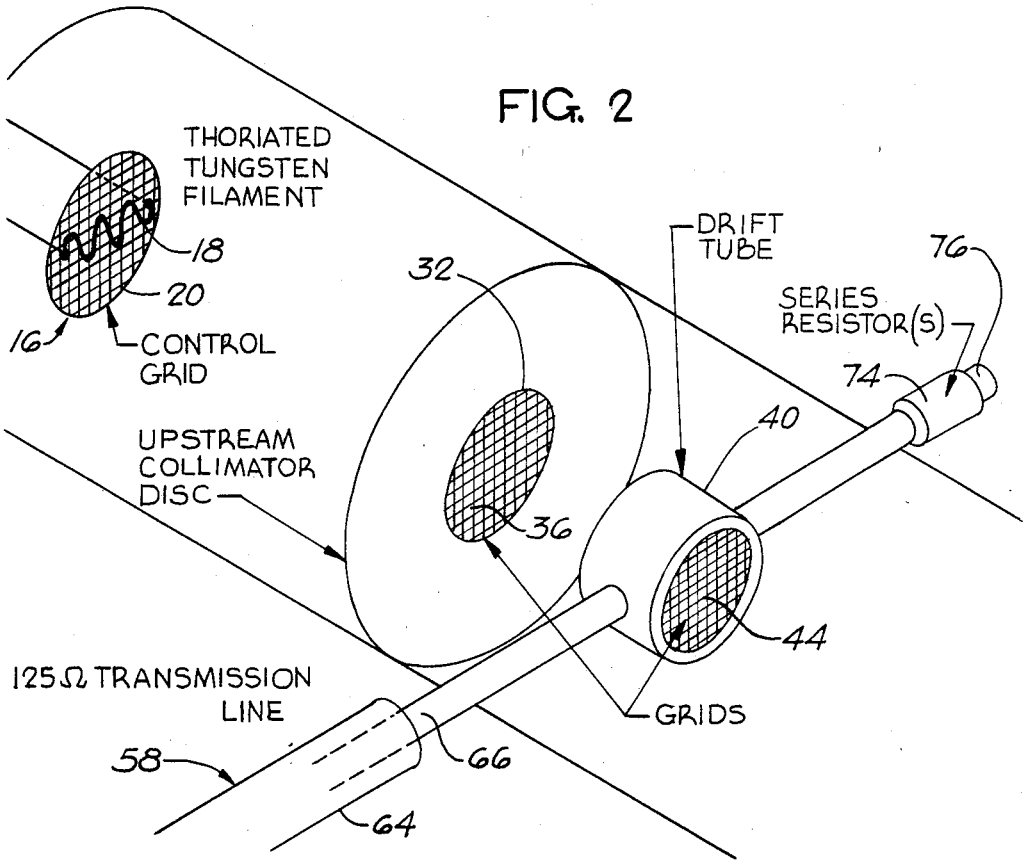
FIG. 2 is a fragmentary perspective view, showing details of the beam buncher of FIG. 1.

FIGS. 1 and 2 illustrate a broad-band beam buncher 10 to be described as an illustrative embodiment of the present invention. The beam buncher 10 comprises a housing or casing 12 which is adapted to be evacuated to form a vacuum space 14 therein. An electron beam is produced in the vacuum space 14 by an electron gun 16, which may be of any known or suitable construction, illustrated as comprising an electron emitting filament 18, which may be made of thoriated tungsten, and a grid 20. The electron gun 16 may also include the usual focussing structure. The filament 18 is supplied with electric power by a filament supply 22. An operating voltage for the grid 20 is supplied by a grid voltage supply 24.

The electron beam from the electron gun 16 is directed through a buncher or modulating cavity 26 comprising a housing 28 extending into and forming part of the housing 12. The main housing 12 and the buncher cavity housing 28 may be made of stainless steel or other suitable conductive material. A positive accelerating voltage is provided between the cavity housing 28 and the filament 18 by an accelerating voltage supply 30 which produces a voltage $V_0$.

As shown, the cavity housing 28 has inlet and outlet openings 32 and 34, through which the electron beam passes in travelling through the cavity 26. Inlet and outlet grids 36 and 38 are preferably provided across the inlet and outlet openings to form surfaces of equal potential.

When the electron beam passes through the cavity 26, it also passes axially through a drift tube electrode 40, disposed in the cavity 26, approximately along the mid-plane of the cavity. Grids 42 and 44 are preferably mounted across the open ends of the drift tube electrode 40. A first drift space 46 is formed within the drift tube electrode 40, such space being substantially free of any electric field.

The modulating cavity 26 and the drift tube electrode 40 provide first and second modulating gaps 50 and 52 between the drift tube 40 and the entrance and exit grids 36 and 38. Modulating voltages on the drift tube 40, relative to the cavity housing 28, produce modulating voltages across these gaps 50 and 52. The two gaps may have different widths, but in the illustrated construction, the two gaps have the same width, designated g. The length of the drift tube electrode 40 is designated d.

The drift tube electrode 40 is supplied with a modulating voltage by modulating means 54, illustrated as comprising a signal source 56 and a transmission line 58 connected between the signal source and the drift tube electrode 40. The signal source 56 comprises a variable frequency signal generator 60 providing ultrahigh frequency signals which are amplified by a broad-band power amplifier 62, having its input connected to the output of the signal generator 60. The transmission line 58 is preferably of the coaxial type and is connected between the output of the amplifier 62 and the drift tube electrode 40. The coaxial transmission line 58 has outer and inner conductors 64 and 66. The modulating cavity 26 constitutes an extension of the outer conductor 64, while the drift tube electrode 40 constitutes an extension of the inner conductor 66. A flaring transitional section 70 is provided between the outer conductor 64 and the cavity housing 28. By thus extending the transmission line 58, a broad-band response is maintained, with a minimum of variations. The extension of the transmission line 58 matches the characteristic impedance of the transmission line, as closely as possible to maintain broad-band response.

The transmission line extension formed by the cavity housing 28 and the drift tube electrode 40 may be terminated by terminating means 72, illustrated as comprising a terminating resistor or impedance 74, connected between the drift tube electrode 40 and a monitor port 76. Either an external terminating resistor 78, or a properly terminated transmission line of the same impedance, may be connected between the monitor port 76 and the cavity housing 28. The monitor port 76 may be employed in making measurements of the modulating voltage between the drift tube electrode 40 and the cavity housing 28.

The electrons in the electron beam are velocity modulated as they travel across the modulating gaps 50 and 52 in the buncher or modulating cavity 26. The velocity modulation is produced by the radio frequency modulating voltage between the drift tube electrode 40 and the cavity housing 28. The velocity modulated electron beam passes out of the cavity 26 through the exit grid 38 into a second drift space 82, formed in a drift tube or housing 84, which may be part of the main housing 12. The drift tube 84 may be made of stainless steel or any other suitable material and may be connected electrically to the cavity housing 28 so as to be at the same voltage. Thus, the drift space 82 is substantially free of any electric field. As the velocity modulated electrons travel along the drift space 82, they are bunched, because the faster electrons tend to catch up with the slower electrons. The drift space 82 has a length L.

The bunched electron beam travels out of the drift space 82 through an exit or discharge opening or aperture 86 formed in an end wall 88. A grid 90 is preferably mounted across the exit opening 86 to provide a surface of equal potential.

The bunched electron beam passes through the exit opening 86 into a utilization device, such as a high voltage accelerator, which may be of the Van de Graaff type. In the accelerator, the bunched electron beam is immediately accelerated to greatly increased velocity and greatly increased energy, and as a result of the velocity greatly exceeding the variation in velocity caused by the previously described modulation, the bunching structure of the beam ceases to evolve further. Thus, the bunching of the electron beam effectively provides pulses of electrons to the accelerator. The pulses are at the frequency of the modulating signal. Harmonics are also present. It will be understood that the second drift space 82 is evacuated, as is the accelerating tube of the accelerator, to which the bunched electron beam is delivered.

To obtain broad-band response, it is desirable to minimize resonance effects in the buncher cavity 26 by terminating the extended transmission line in its characteristic impedance. It will be recalled that the cavity 26 and the drift tube electrode 40 constitute an extension of the transmission line 58. For best broad-band response, the internal terminating resistor 74 and the external terminating resistor 78 are selected to match the characteristic impedance of the extended transmission line, as closely as possible. In this way, variations in the modulation of the electron beam over the response band are minimized.

In some cases, however, it is possible to increase the modulating voltage, so as to increase the modulation level, by increasing the terminating impedance so that it is substantially greater than the characteristic impedance of the standard transmission line. This increase produces a mismatch which results in greater variations in the modulation across the response band. However, due to the feature of broad-banded beam coupling it has been found that such variations can be tolerable and may be justified to obtain a higher level of modulation at selected frequencies within the band.

Figure 4:
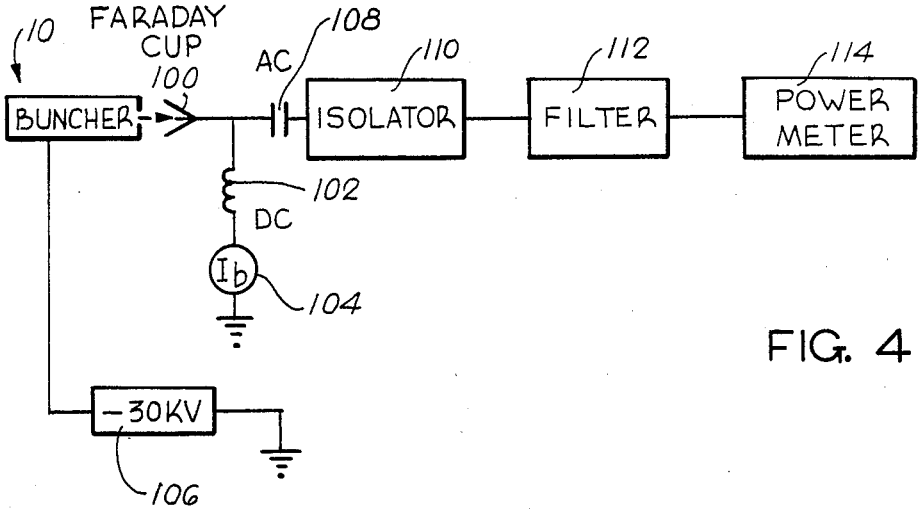
FIG. 4 is a diagrammatic illustration of a test setup to measure the beam bunching modulation produced by the beam buncher.

FIG. 4 illustrates a test setup which has been employed for testing and measuring the electron beam modulation produced by the broad-band beam buncher 10. In this test setup, the bunched electron beam from the beam buncher 10 is directed into a Faraday cup 100 which may be connected to ground through a choke coil 102 and a direct current measuring instrument 104. The bunched electron beam is accelerated by providing a high negative voltage between the beam buncher 10 and ground. Such negative voltage is provided by a DC power supply 106 which may deliver −30 kilovolts, for example.

In the test setup of FIG. 4, the alternating current component of the bunched beam signal delivered to the Faraday cup 100 is coupled through a capacitor 108 to the input of an isolator 110, the output of which is delivered through a filter 112 to a power meter 114. The filter 112 substantially eliminates harmonics, so that the power meter 114 measures the fundamental frequency power of the high frequency pulses delivered by the bunched electron beam from the buncher 10. The results obtained with the test setup of FIG. 4 will be discussed in greater detail presently.

To summarize the operation of the beam buncher 10, an electron beam is produced by the electron gun 16 and is given an initial velocity by the voltage produced by the voltage source 30 between the buncher cavity 26 and the electron gun. The electron beam is velocity modulated as it passes across the gaps 50 and 52 between the drift tube electrode 40 and the entrance and exit grids 36 and 38 of the cavity 26. The modulating signal is applied between the drift tube electrode 40 and the buncher cavity housing 28 by the transmission line 58 which derives the signal from the broad-band power amplifier 62 of the signal source 56.

The velocity modulated electrons pass through the grid 38 into the drift space 82, where the velocity modulation results in bunching of the electrons. The bunched electron beam then passes out of the drift space 82 through the grid 90, into a high voltage accelerator or some other utilization device.

The buncher cavity 26 and the drift tube electrode 40 are arranged to constitute an extension of the transmission line 58, and such extension may be terminated in approximately its characteristic impedance, to minimize resonance effects in the cavity 26 and to obtain a broad-band response, with a minimum of variations across the response band. In some cases, the terminating impedance may be increased to increase the modulation level at selected frequencies within the band, while still maintaining a broad response band with tolerable variations, as a result of the broad-banded beam coupling feature.

The bunching characteristics for the two-gap modulator are obtained in a manner similar to that used for the conventional klystron. If the applied modulating signal is of the form $V=V_1 \sin \omega t$, the effective modulating voltage experienced by an electron is $<V>=V_1 M(\omega) \sin \omega t$, where the term $M(\omega)$ is known as the beam coupling coefficient. For the two-gap modulator, $$M(\omega) = \frac{2 \sin(\theta_g/2) \sin[(\theta_g + \theta_d)/2]}{\theta_g/2} \quad (1a)$$

where $$\theta_d = \omega d/v_0 \; \theta_g = \omega g/v_0 \quad (2a,b)$$

g,d=gap and drift-tube lengths (respectively)
$V_0$=pre-acceleration voltage
$V_0$=velocity resulting from $V_0$
For the case of equal gaps (d=g)

$$M(\omega) = \frac{2 \sin(\theta_g/2) \sin \theta_g}{\theta_g/2} \quad (1b)$$

The spatial bunching which the beam undergoes after having traversed a drift space of length L (the beam is rapidly accelerated immediately upon exiting the drift space, thereby "freezing" the existing bunching from that point on) can be expressed in terms of the bunching parameter X, which is given by $$X = \frac{M(\omega) V_1 \omega L}{2 V_0 v_0} \quad (3)$$

If the modulated beam current is expanded in a Fourier series with fundamental frequency $\omega$, the modulation amplitude of the $n^{th}$ harmonic is given by $$I_n = 2 I_0 J_n(nX) \quad (5)$$

where $I_0$ is the d.c. beam current. From Eq. (5) we see that the maximum modulation for the $n^{th}$ harmonic is obtained when nX corresponds to the maximum of $J_n$.

In conventional klystron theory, where power gain considerations are the primary concern, it is the beam coupling coefficient $M(\omega)$ which is of interest. However, for constructing a broad-banded device, one is concerned with the frequency dependence of the bunching parameter, which Eq. (3) shows is dependent not on $M(\omega)$ itself, but on the product $\omega M(\omega)$. Since minimum variation of any function occurs in the neighborhood of the maximum of that function, to minimize the frequency variation of the output, one should design the device so that not only X is a maximum but $\omega M(\omega)$ is maximized as well. This double maximization is what we describe as broad-banded beam coupling. It will be recognized that broad-banded beam coupling also serves to minimize the frequency variation of the output should the amplitude of the modulating voltage $V_1$ vary with frequency.

For the equal gap buncher, the maximum of $\omega M(\omega)$ occurs for $\theta_g/2=0.9953$, and $\sin(\theta_g/2) \sin \theta_g$ becomes 0.7698. If one wishes to operate over a one-octave range, from $\omega_1$ to $\omega_2=2\omega_1$, about a midband frequency $\omega_0$, then for minimum frequency variation of X, $$g = \frac{1.911 \, v_0}{\omega_0} \quad (6)$$

Figure 3:
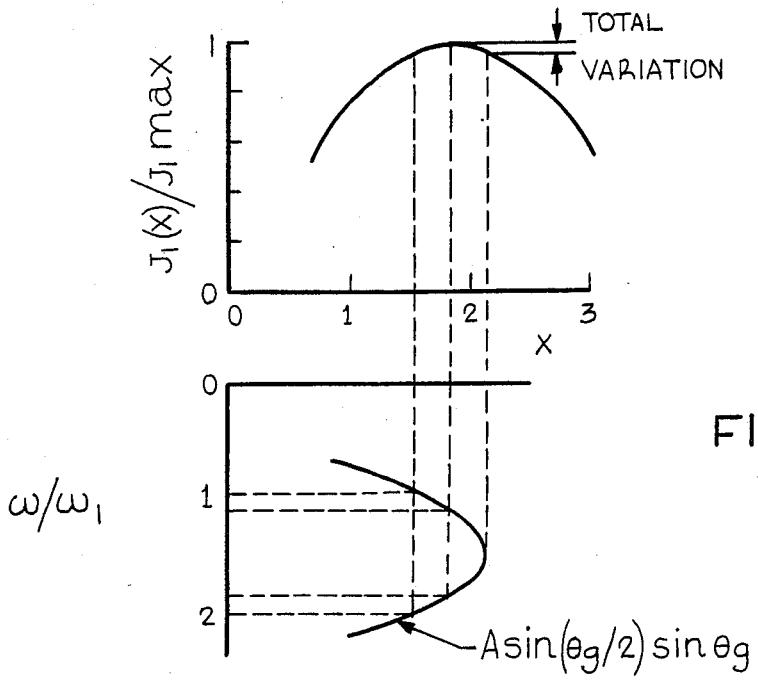
FIG. 3 is a set of graphs, illustrating certain aspects of the theory and operation of the beam buncher.

In seeking to minimize the frequency variation of $J_n$ over the entire octave, rather than maximizing $J_n(nX)$ at midband, one should choose the remaining parameters so that $X(\omega_0)$ and $X(\omega_1) \cong X(\omega_2)$ are roughly equidistant from the optimum X. The method is illustrated graphically in FIG. 3 for the case of n=1. ($[J_1(X)]_{max}$ occurs for X=1.841.) The curve in the lower graph illustrates the underlying frequency dependence of X. The constant A has been adjusted to show the condition for minimum frequency variation. This situation obtains when $J_1(X)$ is at a maximum where $\sin(\theta_g/2) \sin \theta_g \cong 0.86 \times 0.7698$; this results in the relation $$\frac{V_1 L}{V_0 g} = 1.390 \quad (7)$$

If one were in practice able to realize the situation described, it would be possible to keep the output modulation amplitude constant to ±1.5% over a one-octave frequency range.

To extend the frequency range over two octaves, i.e., from $\omega_1$ to $4\omega_1$, two approaches are possible. Using the above method, and optimizing the system for a two-octave range, one can achieve a modulation amplitude which would vary by ±19%. An alternate approach would be to make use of the harmonic spectrum of the output beam. One still maximizes $\sin(\theta_g/2) \sin \theta_g$ at $\omega_0=1.5\omega_1$, but obtains the bunching between $2\omega_1$ and $4\omega_1$ by optimizing X for n=2, i.e. operating in the neighborhood of the first maximum of $J_2(2X)$, namely $2X \cong 3.05$.

The only way to switch back and forth from first to second harmonic operation without changing hardware or affecting the optimization of $\sin(\theta_g/2) \sin \theta_g$ is by changing $V_1$; denoting the modulating voltages for first and second harmonic operation by $V_1^{(1)}$ and $V_1^{(2)}$ respectively, the requirement for optimizing both modes is $$V_1^{(2)} = 0.833 V_1^{(1)} \quad (8)$$

Analysis similar to that described above indicates that the second harmonic amplitude of the bunched beam will vary by less than ±3.5% over the (output) frequency range $2\omega_1$ to $4\omega_1$. The one drawback to this scheme arises from the fact that $[J_2(x)]_{max} \cong 0.83[J_1(x-$ $)]_{max}$, so that the modulation amplitude suffers a 17% discontinuity as one switches from first harmonic to second. Notwithstanding this effect, the *overall* variation in the output amplitude is still only about 20%, roughly half as much as in the alternate scheme. An additional practical consideration favoring the second harmonic scheme is that in the frequency range of interest, electronics capable of supplying constant output voltage over a tow-octave frequency range are either very expensive or unavailable.

In summary, it is possible to minimize the variation of the output response with frequency, as well as the variations in input response, by introducing the technique of broad-banded beam coupling. The parameters to be varied in order to accomplish this include the width g of the modulating gaps 50 and 52 in the buncher cavity 26, the length d of the drift tube electrode 40, the length L of the second drift space in which the velocity modulated electrons are bunched, and the initial voltage which accelerates the electrons as they travel between the electron gun and the buncher cavity. The preceeding discussion describes the novel approach involved in producing a broad-banded output characteristic through the use of broad-banded beam coupling, and sets forth the relationships for determining these parameters, so as to realize such coupling.

The flatness of the broad-band response is also effected by the termination of the modulator transmission line, as extended by the buncher cavity housing 28 and the drift tube electrode 40. To enhance such flatness, the extended transmission line may be terminated in its characteristic impedance. However, as a result of the mitigating effect of broad-banded beam coupling, a somewhat greater terminating impedance may be employed to obtain a higher modulating level at certain frequencies within the band, with greater but still tolerable variations in the broad-band response.

An electron buncher has been constructed based on the above considerations. An electron gun, consisting of a thoriated tungsten filament, a control grid and a combination focussing and pre-acceleration electrode ($V_0$=400–500 V) produced the electron beam. The beam then passed through a 3 mm collimating aperture into the buncher cavity at the center of which was mounted the cylindrical drift tube on which the modulating signal appeared. A second collimator was followed by a stainless steel tube which served as the drift space. Fine rectangular grids of 1 mil tungsten wire spaced at roughly 0.5 mm were placed over the entrance and exit collimators and both ends of the drift tube in order to maintain planar equipotential surfaces at these locations.

The buncher is to operate over the frequency range 1–4 GHz, so that $\omega_0$, the midband frequency (for first or second harmonic operation), is 1.5 GHz. The modulating signal is supplied by a power amplifier driven by a voltage-controlled 1–2 GHz YIG oscillator. Using a pre-acceleration voltage of 400 V, Eq. (6) gives for the gap spacing g=2.4 cm. With $V_0$ and g now fixed at the above values, Eq. (7) shows that optimization of X requires that $V_1L$=133 V-cm.

Since the buncher is to be installed in the terminal of a Van de Graaff accelerator, it is desirable to maintain L at a reasonable length. To minimize the power requirements for the amplifier one wants to keep $V_1$ small. A reasonable compromise was adopted with $V_1$=10 V and L=13.3 cm. For a given $V_1$, the power requirements can be reduced by using a higher impedance input transmission line (and designing the buncher cavity accordingly). For example, with a 125 ohm impedance, a 10 volt (peak) modulating signal only requires 0.4 W. The input power requirement can be reduced further, at the expense of a varying input lever, by using a mismatched input transmission line. Because of the difficulties in obtaining adequate amplifier performance, we elected to take this latter approach in the present series of tests, driving the 125 ohm cable with a 50 ohm source, and terminating it in 307 ohm, i.e., a 257 ohm resistor in series with the 50 ohm monitoring port.

The buncher's performance was evaluated on a test stand which accelerated the beam to 30 kV and, with the use of appropriate magnets, steered and focussed in onto a Faraday Cup whose frequency response was relatively flat to 2 GHz and extended out beyond 4 GHz. The beam detection circuit is shown in FIG. 4. Since the power meter is a broad-band device, a filter is necessary due to the presence of higher harmonics in the beam; to measure the frequency response over an entire octave, two different filters are needed. Because the Faraday Cup is hot back-terminated, an isolator is necessary to prevent reflected power from producing resonances in the detection circuit.

Figure 5:
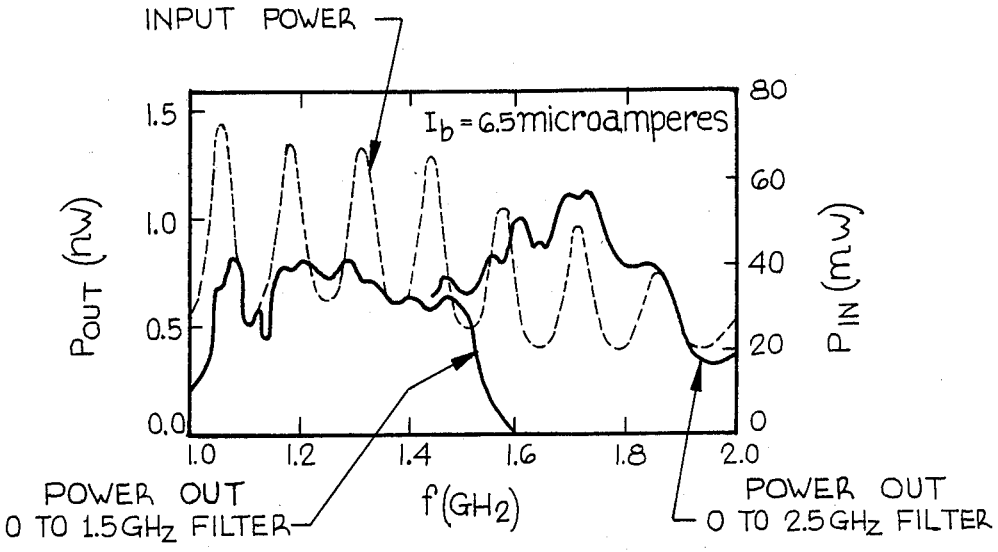
FIG. 5 is a set of graphs, showing the input and output modulation of the beam buncher, as measured by the test setup of FIG. 4.

FIG. 5 shows the experimental results. The dashed curve shows the input modulating signal measured at the monitoring port as a function of frequency. The partially resonant behavior of the mismatched transmission line is clearly evident. The falloff at the upper frequencies is due to the output characteristics of both the YIG oscillator and the amplifier. The lower curves in full lines show the output power associated with the first harmonic component of the bunched beam. The lower half of the spectrum was recorded using a filter with a 1.5 GHz roll-off; the upper half, with a 2.5 GHz roll-off. A slight difference in the insertion loss of the two filters if visible. Over roughly the lower $\frac{2}{3}$ of the octave the double peaking of the output oscillations relative to the input clearly shows the variation of X above and below its optimum value as $V_1$ varies. The smoothing effect of optimizing X is also evident: Variations of ±40% in input power level result in output power variations of less than ±10%. The falloff at the highest frequencies reflects the falloff in the input. The falloff at the very lowest frequencies, and the peaking observed in the neighborhood of 1.7 GHz, appear to be at least partly due to the frequency response of the measuring circuit, which can be corrected.

Owing to the uncertainty of the Faraday Cup response above 2 GHz, no extensive measurements were taken over the 2–4 GHz region. However, preliminary measurements using a spectrum analyzer indicate the presence of output harmonics up to n=4.

The present results are very encouraging. Driving the buncher with signal levels whose amplitude varied over a 2:1 range we were able to keep the modulation amplitude of the output current constant to ±20% over nearly a one-octave interval. It is believed to be possible to upgrade the modulation amplifier to reduce input signal variations and improve the response of the output measuring circuit.

The buncher has been found to be a satisfactory and very useful source of bunched electrons to be supplied to a high voltage accelerator of the Van de Graaff type.

The invention is also applicable to the broad-band bunching of positive ions and other charged particles.

What is claimed is:

1. A broad-band beam buncher, comprising:

a housing adapted to be evacuated, an electron gun in said housing for producing a beam of electrons, buncher means in said housing forming a buncher cavity having an entrance opening for receiving the electron beam and an exit opening through which the electron beam passes out of said buncher cavity, a drift tube electrode in said buncher cavity and disposed between said entrance opening and said exit opening with first and second gaps between said drift tube electrode and said entrance and exit openings, said drift tube electrode having a first drift space therein through which the electron beam passes in traveling between said entrance and exit openings, modulating means for supplying an ultrahigh frequency modulating signal to said drift tube electrode for producing velocity modulation of the electrons in the electron beam as the electrons pass through said buncher cavity and said drift tube electrode between said entrance opening and said exit opening, drift space means in said housing forming a second drift space for receiving the velocity modulated electron beam from said exit opening, said velocity modulated electron beam being bunched as it passes along said second drift space, said drift space means having a discharge opening through which the electron beam is discharged from said second drift space after being bunched therein, said modulating means comprising a signal source for producing an ultrahigh frequency signal, a transmission line connected between said signal source and said drift tube electrode, and terminating means connected to said drift tube electrode for terminating said transmission line in approximately its characteristic impedance to afford a broad response band with minimum variations therein.

2. A beam buncher according to claim 1, including a voltage source for producing a positive voltage between said buncher cavity means and said electron gun for imparting velocity to the electron beam as it passes into said buncher cavity through said entrance opening.

3. A beam buncher according to claim 2, including an entrance grid across said entrance opening in said buncher cavity, and an exit grid across said exit opening of said buncher cavity.

4. A beam buncher according to claim 3, including drift tube electrode grids across the opposite ends of said drift tube electrode.

5. A beam buncher according to claim 4, including a discharge opening grid across said discharge opening.

6. A beam buncher according to claim 1, wherein said transmission line is coaxial and has inner and outer conductors, said buncher cavity constituting an extension of said outer conductor, said drift tube electrode constituting an extension of said inner conductor of said coaxial transmission line for approximately matching the impedance of said transmission line.

7. A beam buncher according to claim 1, including a voltage source for producing a positive accelerating voltage between said buncher cavity means and said electron gun for imparting velocity to the electron beam as it passes into said buncher cavity through said entrance opening, said accelerating voltage, said first and second gaps, the length of said drift tube electrode, and the length of said second drift space being proportioned to afford broad-band beam bunching over a broad frequency range of said modulating signal.

8. A beam bucher according to claim 7, said transmission line being a coaxial line having inner and outer coaxial conductors, said buncher cavity constituting an extension of said outer conductor, said drift tube electrode constituting an extension of said inner conductor of said coaxial transmission line for approximately matching the impedance of said transmission line.

9. A broad-band beam buncher, comprising:

a housing adapted to be evacuated, beam producing means in said housing for producing a beam of charged particles buncher means in said housing forming a buncher cavity having an entrance opening for receiving the beam and to an exit opening through which the beam passes out of said buncher cavity, a drift tube electrode in said buncher cavity and disposed between said entrance opening and said exit opening with first and second gaps between said drift tube electrode and said entrance and exit openings, modulating means for supplying a high frequency modulating signal to said drift tube electrode for producing velocity modulation of the charged particles in the beam as the particles pass through said buncher cavity and said drift tube electrode between said entrance opening and said exit opening, drift space means in said housing forming a second drift space for receiving the velocity modulated beam from said exit opening, said velocity modulated beam being bunched as it passes along said second drift space, said drift space means having a discharge opening through which the beam is discharged from said second drift space after being bunched therein, a voltage source for producing an accelerating voltage between said buncher cavity and said beam producing means for imparting velocity to the beam as it passes into said buncher cavity through said entrance opening, said modulating means comprising a signal source for producing a high frequency signal, a coaxial transmission line connected between said signal source and said drift tube electrode, said coaxial transmission line having inner and outer conductors, said buncher cavity constituting an extension of said outer conductor, said drift tube electrode constituting an extension of said inner conductor of said coaxial transmission line for approximately matching the impedance of said transmission line, said accelerating voltage, said first and second gaps, the length of said drift tube electrode, and the length of said second drift space being proportioned to afford broad-band beam bunching over a broad frequency range of said modulating signal, and terminating means connected to said drift tube electrode for terminating said transmission line in approximately its characteristic impedance to afford a broad output band with minimum variations therein.

10. A broad-band beam buncher, comprising:

a housing adapted to be evacuated, an electron gun in said housing for producing a beam of electrons, buncher means in said housing forming a buncher cavity having an entrance opening for receiving the electron beam and an exit opening through which the electron beam passes out of said buncher cavity, a drift tube electrode in said buncher cavity and disposed between said entrance opening and said exit opening with first and second gaps between said drift tube electrode and said entrance and exit openings, said drift tube electrode having a first drift space therein through which the electron beam passes in traveling between said entrance and exit openings, modulating means for supplying an ultrahigh frequency modulating signal to said drift tube electrode for producing velocity modulation of the electrons in the electron beam as the electrons pass through said buncher cavity and said drift tube electrode between said entrance opening and said exit opening, drift space means in said housing forming a second drift space for receiving the velocity modulated electron beam from said exit opening, said velocity modulated electron beam being bunched as it passes along said second drift space, said drift space means having a discharge opening through which the electron beam is discharged from said second drift space after being bunched therein, said modulating means comprising a signal source for producing an ultrahigh frequency signal, a transmission line connected between said signal source and said drift tube electrode, and terminating means connected to said drift tube electrode for terminating said transmission line in an impedance substantially greater than its characteristic impedance to afford a broad response band with an enhanced modulation level and tolerable variations therein.

* * * * *